US005384164A

United States Patent [19]

Browning

[11] Patent Number: 5,384,164

[45] **Date of Patent: * Jan. 24, 1995**

[54] FLAME SPRAYED COATINGS OF MATERIAL FROM SOLID WIRE OR RODS

[76] Inventor: James A. Browning, c/o Browning Thermal Systems, Inc., P.O. Box 477, Enfield, N.H. 03748

[ * ] Notice: The portion of the term of this patent subsequent to Dec. 13, 2011 has been disclaimed.

[21] Appl. No.: 988,287

[22] Filed: Dec. 9, 1992

[51] Int. Cl.[6] ..... B05D 1/08

[52] U.S. Cl. ..... 427/449; 427/446; 239/83

[58] Field of Search ..... 427/446, 449; 239/83, 239/84, 79

[56] References Cited

U.S. PATENT DOCUMENTS

| | | | |
|---|---|---|---|
| 2,125,764 | 8/1938 | Benoit | 239/79 |
| 2,861,900 | 11/1958 | Smith et al. | 427/446 |
| 4,121,083 | 10/1978 | Smyth | 427/446 |
| 4,235,943 | 11/1980 | McComas et al. | 427/446 |
| 4,568,019 | 2/1986 | Browning | 239/83 |
| 4,634,611 | 1/1987 | Browning | 239/81 |
| 4,960,458 | 10/1990 | Browning | 427/449 |
| 5,120,582 | 6/1992 | Browning | 427/446 |

*Primary Examiner*—Shrive Beck

*Assistant Examiner*—Katherine A. Bareford

*Attorney, Agent, or Firm*—Sughrue, Mion, Zinn, Macpeak & Seas

[57] ABSTRACT

A plasma jet or a supersonic flame jet emanating from an internal burner combusting compressed air and fuel is applied to a solid rod coaxially within the flame or plasma jet to heat, atomize and project a spray of initially liquid droplets of the rod material separating from the tip of the rod in the direction of a workpiece for impact against a workpiece surface for solidification to form a coating thereon. The process involves the control of the transit of the initially liquid droplets from the tip of the rod over the path of travel to the surface of the workpiece to ensure that at the moment of impact against the surface of the workpiece the rod material particles are least partially solid. The stand-off distance may be set to ensure that the initially liquid droplets pass through an upstream liquid region and a contiguous downstream transit region to effect the partial solidification of the molten liquid droplets prior to impact. The control of the transit of the initially liquid droplets may be effected by adding a liquid or gas coolant into the jet stream to cool both the jet stream gases and the initially liquid droplets downstream of the point where the liquid droplets separate from the tip of the rod.

4 Claims, 1 Drawing Sheet

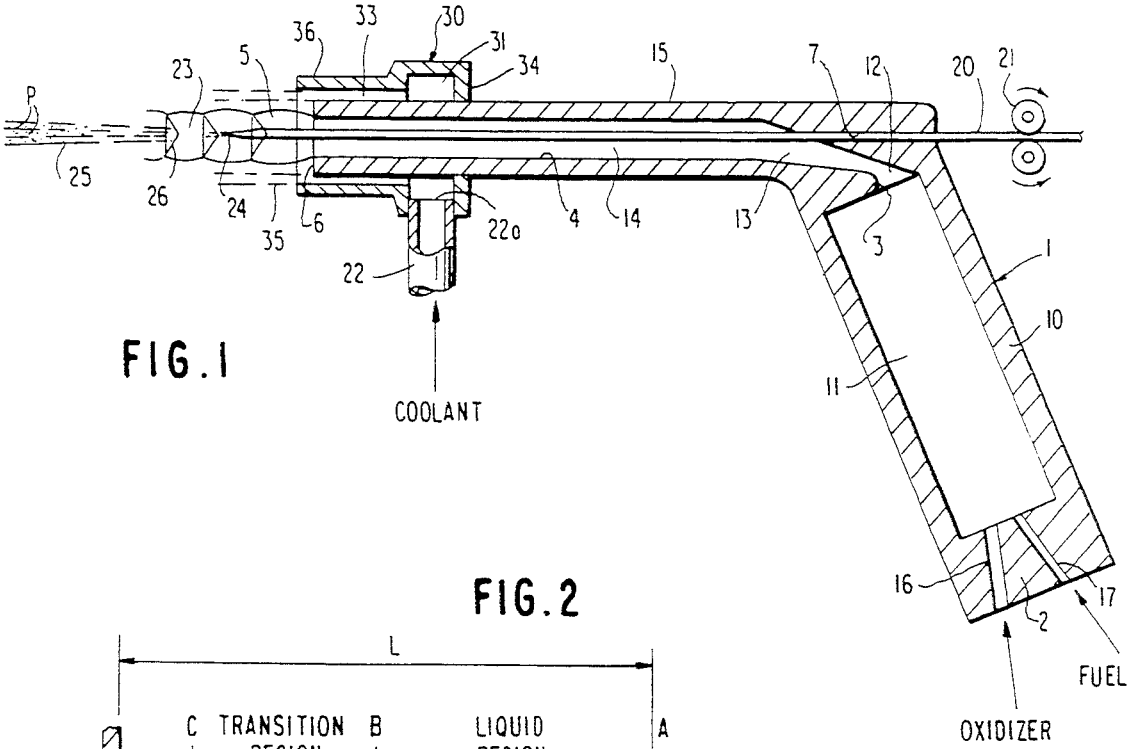
FIG. 1
FIG. 2
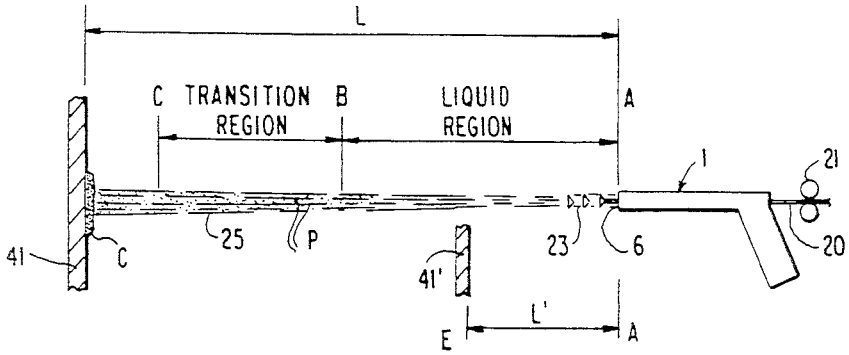
FIG. 3a
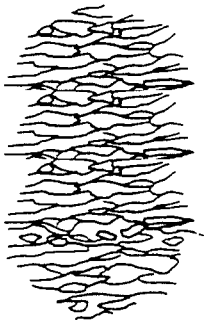
FIG. 3b
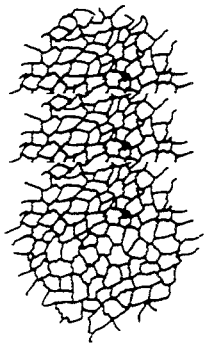

FLAME SPRAYED COATINGS OF MATERIAL FROM SOLID WIRE OR RODS

FIELD OF THE INVENTION

This invention relates to controlling the transit parameters of molten particles from their exit of a flame spray gun nozzle to a workpiece spaced at some distance from the nozzle exit, and more particularly to the production of coatings where such previously molten particles have been changed to either the solid or plastic state.

BACKGROUND OF THE INVENTION

The development of High Velocity Oxygen Fuel (HVOF) spray devices involve the heating of powder particles which are heated and impacted against a workpiece surface to form a coating thereon. Such field is exemplified by my U.S. Pat. No. 5,120,582 issued Jun. 9, 1992 and entitled "MAXIMUM COMBUSTION ENERGY CONVERSION AIR FUEL INTERNAL BURNER." In recent developments within this art, I have learned that the best coatings are produced when the heated particles are in either their solid or plastic state. Further, when in their solid or plastic state, it is possible to increase the temperature of the particles corresponding to the kinetic energy expended upon impact of the high velocity particles against the surface of the workpiece to be coated and to even melt high melting point materials sufficiently to ensure a firm mechanical bond with the surface of the workpiece to be coated. Such basic impact fusion technique has its genesis in U.S. Pat. No. 2,861,900 issued Nov. 25, 1958 and entitled "JET PLATING OF HIGH MELTING POINT MATERIALS."

I have found that fully molten particles are not desired as, upon impact, they splatter with resulting high oxide levels as well as creating voids in the coating. Also, the liquid particles impose a high heat load against the workpiece and in the coating itself, leading to high internal tensile stresses. Thus, only thin coating layers can be produced using liquid particle impingement on a substrate or workpiece, as tensile forces lead to cracking and coating separation from the substrate material.

For these reasons, high-quality coatings, are, now, nearly universally the result of using powdered feed material and by controlling the heat input to the particles to assure that fully fused particles do not result. Supersonic jet velocities are now common, leading to high particle impact velocities against the substrate surface. Such knowledge has resulted from employing the process and apparatus such as that exemplified by my U.S. Pat. No. 5,120,582.

Importantly, when wires or rods are substituted for powder in such supersonic flame jet spray devices (HVOF), the coating material must be melted to produce spray particles as droplets. The molten liquid drops at normally used stand-off distances (gun exit or outlet to Substrate or workpiece surface) remain liquid upon impact and splatter energetically forming porous and oxidized coatings. Conventionally when using the HVOF process and apparatus to spray powdered material, the stand-off distance is usually between 5 and 12 inches. Increasing the stand-off distance is not desirable, since many of the particles lose so much of their internal energy that, upon impact they bounce off the target or remain as solid particles within the coating as it builds on the face of the workpiece, thereby forming a weak spot due to improper adhesion to adjoining particles.

The present invention is premised on the discovery that by doubling, for instance, the normal stand-off distance of flame spray apparatus of the internal burner type using solid wire or rod as the coating material feed which is fed axially through the flame spray gun and into and coaxial with the flame spray itself in contrast to such flame spray apparatus which is customarily used with such gun or internal burner supplied with a coating material in powder form, the increase in the stand-off distance allows time for the liquid particles to lose a sufficient amount of heat and to become plastic, or even solid, rather than molten prior to impact on the face of the workpiece. Under such conditions, upon impact there is little, or no, splattering and the coatings building on the workpiece face appear very similar to their powder-sprayed counterparts possessing high density and strength and having significantly reduced oxide content.

These and other features, objects and advantages of this invention will become apparent from the following detailed description along with the accompanying drawings.

BRIEF DESCRIPTION OF THE DRAWINGS

FIG. 1 is a schematic, longitudinal cross-sectional view of a preferred form of a jet flame gun adapted for the practice of this invention.

FIG. 2 illustrates schematically, the gun of FIG. 1 employed in accordance with the method of the present invention to ensure the build-up of a high density, high strength flame spray coating on a workpiece at proper stand-off distance to provide a coating having a considerably reduced oxide content, in contrast to that of the prior art.

FIG. 3*a* is a sketch of a section through a portion of a flame spray coating as a result of high liquid droplet impact on a workpiece in accordance with prior art practice.

FIG. 3*b* is a similar section through a portion of a coating on a workpiece of using a similar material and with a proper stand-off distance and transit parameter control of the particles prior to impact against the face of the workpiece employing the process which forms a preferred embodiment of the invention.

DESCRIPTION OF THE PREFERRED EMBODIMENTS

Referring to FIG. 1, a flame spray apparatus or gun indicated generally at 1 comprises a body 10 of cylindrical form, which may function as a handle, which is hollow. The body forms via an end wall 2 at one end and an expansion nozzle 12 at the opposite end, a generally closed combustion chamber 11. An oxidizer from a source indicated by the arrow labeled oxidizer, is injected through a small diameter passage or port 16 within wall 2 opening interiorly to the combustion chamber 11. Passage 16 is at an angle such that the air or oxygen of the oxidizer intersects fuel from a source indicated by the arrow labeled Fuel entering through a smaller diameter passage or port 17. Such oxidizer and fuel is metered in amounts so as to yield nearly stoichiometric combustion of a fuel and air mixture within the combustion chamber 11. Ignition may be effected by a spark plug (not shown) or flashback from the nozzle diverging bore section 13 downstream of a throat 3 within the expansion nozzle 12. The nozzle is a typical converging diverging nozzle, the result of which is to increase the velocity of the expanding gases which are the products of combustion of the fuel and air and oxidizer mixture within combustion chamber 11 through a nozzle extension passage 14 of nozzle extension 15 integral with the expansion nozzle 12 and body 10. The expanding gas forms a flame spray 5 which exits from the exit end 6 of the nozzle extension 15.

A wire or rod 20 of a material to be flame sprayed is fed through a small diameter hole 7 within the nozzle 12 axially aligned with bore 4 within the nozzle extension 15, with the wire or rod 20 melted by contact with the high temperature expanding gases. The rod 20 is fed at constant velocity through the nozzle extension passage 14 by means of oppositely rotated power rolls 21 functioning as drive means for the wire or rod 20. The hot gases of the products of combustion pass concurrently with the wire or rod 20 and the products of combustion move at supersonic velocity within that passage to heat the rod to the melting point of the material forming the same. The rod material is atomized by the supersonic gas flow at point 24 downstream of the exit end 6 of the nozzle extension 15 to form a tight spray cone 25 of liquid droplets. The exiting flame spray takes the typical supersonic flow form as illustrated, exhibiting spaced shock diamonds 26 within that stream. In the apparatus of FIG. 1, the stand-off distance L in accordance with FIG. 2, which is the distance from the exit end 6 of the gun 1 to the workpiece 41 downstream therefrom may be too great for practical flame spraying of the material of wire or rod 20. However, such desired stand-off L must include the initial region between points A, B labeled "Liquid Region" in which the particles P within the spray cone are in the form of liquid droplets, while those same particles within the downstream "Transition Region" of the flame jet stream 23 from point B to point C along that flow path tend to plasticize. Downstream of point C, the particles may even become solid prior to impact against the face of the workpiece 41 to create a coating C which builds up on the face of the workpiece in the path of the sprayed particles P. Under such conditions, higher cooling rates are required for the molten droplets of spray cone 25, i.e. the particles P of material which are molten downstream of the separation point 24 of molten material from the balance of the wire or rod 20 of the material to be sprayed.

Such higher cooling rates may be effected using, for instance, cooling means indicated generally at 30, FIG. 1. The cooling means 30 is comprised of a hollow body 34 of cylindrical form surrounding the tubular nozzle extension 15 being of larger diameter and forming with nozzle extension 15, an annular manifold 31. A supply of coolant such as air, water or other cooling medium as indicated by the arrow labeled "Coolant" enters the coolant inlet pipe 32, whose end **22*a* opens to the manifold 31. The body 34 has a reduced diameter outlet section 36 which is radially spaced from the outer periphery of the nozzle extension 15 so as to form a narrow annulus 33 which projects longitudinally slightly beyond the end 6 of the nozzle extension 15**.

A source of coolant under pressure as indicated by the arrow labeled coolant enters the coolant supply tube 32 which opens to the manifold 31 and permits air, water or other cooling medium to enter the manifold 31 and to exit from the annulus 33 as a high velocity annular stream 35 which flows along the outer surface of the supersonic flame jet 23. The cooling medium flows and mixes into the jet 23, thereby cooling both the jet gases and the molten particles P contained in cone 25. Rapid particle cooling is effected, thus reducing the stand-off distance L, otherwise required to meet the process step criteria of this invention.

This may be best appreciated by further reference to FIG. 2. If powder were being sprayed with the HVOF process using the gun 1, the stand-off distance is much shorter, i.e. at L′ from point A at the exit end 6 of the nozzle extension 15 to point E, at which point is positioned a workpiece 41′. Such stand-off distance L′ is at a maximum 12 inches. In contrast to the distance to workpiece 41 can be as great as 3 feet for optimum coatings using wire or rod as the source of the flame sprayed material in particle form.

It should be understood that the new features of the process of this invention and the modification of the flame spray gun construction herein disclosed may be employed in ways and forms different from those of the preferred embodiment described above without departing from the spirit and scope of the invention as defined in the appended claims.

What is claimed is:

1. In a flame spray method including steps of:

feeding a rod of solid material to be flame sprayed in and through a flame to heat, atomize and project a spray of particles against a workpiece to be coated, the improvement comprising:

controlling transit of said particles in molten droplet form over a path of travel of said particles from a tip of said rod to a surface of the workpiece such that initially liquid droplets of said material separated from and projected from the tip of the rod are at least partially solid at a moment of impact against a surface of the workpiece, spacing the workpiece from a point of separation of the liquid droplets from the tip of the rod at a stand-off distance sufficient to cause the liquid droplets to pass through an initial upstream liquid region and a contiguous downstream transition region from liquid to at least partially solid, wherein said flame is a supersonic flame, and said method further comprises continuously combusting under pressure a continuously supplied compressible combustible gas and fuel mixture including oxygen within an internal burner combustion chamber and discharging combustion product gases from a combustion chamber orifice through an expansion nozzle open at its downstream end via a nozzle extension and forming a supersonic jet exiting said nozzle extension, and said step of controlling the transit of the liquid droplets over the path of travel of the particles to be sprayed from the tip end of the rod to said surface of the workpiece comprises feeding said rod axially through said nozzle extension and causing a flow of liquid coolant to exit from an annulus about an outer periphery of the nozzle extension, and at an exit end of said nozzle extension as an annular coolant stream flowing along an outer surface of the supersonic jet downstream of the exit end of the nozzle extension from the tip of said rod towards said workpiece to thereby effect rapid cooling of the liquid droplets to at least partially solid form prior to impact on the workpiece surface, while substantially reducing the stand-off distance between the exit of the nozzle extension and the workpiece.

2. The method as claimed in claim 1, wherein said step of causing said flow of coolant fluid to exit from an annulus about an outer periphery of the nozzle extension as an annular stream of coolant comprises flowing said annular stream of coolant throughout at least said liquid region.

3. The method as claimed in claim 1 wherein said step of causing a flow of coolant fluid to exit from an annulus about an outer periphery of the nozzle extension as an annular stream of coolant flowing along an outer surface of the supersonic jet comprises flowing said annular stream of coolant throughout said liquid region and said transition region.

4. The method as claimed in claim 1, wherein said coolant is an annular stream of liquid, and wherein the coolant flows and mixes into the jet stream for cooling both jet stream gases and molten particles contained in a cone of the jet stream.

* * * * *